US006209290B1

(12) United States Patent
Boriani et al.

(10) Patent No.: US 6,209,290 B1
(45) Date of Patent: Apr. 3, 2001

(54) PACKET FOR LONG ARTICLES AND THE RELATED PACKAGING METHOD

(75) Inventors: Silvano Boriani, Bologna; Lorenzo Cocchi, San Lazzaro di Savena; Chiara Colo', Fiumalbo; Alessandro Minarelli, Bazzano, all of (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 09/333,952

(22) Filed: Jun. 16, 1999

(30) Foreign Application Priority Data

Jun. 23, 1998 (IT) ..... B098A0384

(51) Int. Cl.[7] ..... B65B 35/30; B65B 61/20

(52) U.S. Cl. ..... 53/445; 53/131.2; 53/135.1; 53/148; 53/415; 53/461; 493/375; 493/382

(58) Field of Search ..... 53/449, 461, 444, 53/148, 131.2, 135.1, 415; 493/375, 376, 382

(56) References Cited

U.S. PATENT DOCUMENTS

| | | | | |
|---|---|---|---|---|
| 2,854,799 | * | 10/1958 | Griese et al. | 229/236 |
| 3,260,405 | | 7/1966 | Frischer et al. | 206/271 |
| 3,506,353 | | 4/1970 | Gilchrist, Jr. | 355/112 |
| 3,746,606 | | 7/1973 | Chao | 156/334 |
| 4,100,011 | * | 7/1978 | Foote | 156/275.1 |
| 4,273,603 | * | 6/1981 | Peronnet et al. | 156/238 |
| 4,651,877 | | 3/1987 | Adrianus de Mooy | 206/525 |
| 4,784,261 | | 11/1988 | Kutchin | 206/271 |
| 4,836,378 | * | 6/1989 | Lephardt | 206/271 |
| 4,883,161 | * | 11/1989 | Focke | 198/447 |
| 5,073,221 | * | 12/1991 | Waitts et al. | 156/155 |
| 5,137,148 | | 8/1992 | Evers | 206/271 |
| 5,372,386 | * | 12/1994 | Mills | 235/385 |
| 5,428,346 | | 6/1995 | Franklin | 206/204 |
| 5,533,613 | * | 7/1996 | Minarelli et al. | 206/242 |
| 5,621,864 | * | 4/1997 | Benade et al. | 707/500 |
| 5,823,350 | | 10/1998 | Ward | 206/807 |
| 5,826,785 | | 10/1998 | Belvederi et al. | 206/273 |
| 5,931,292 | | 8/1999 | Focke et al. | 206/459.5 |

FOREIGN PATENT DOCUMENTS

| | | |
|---|---|---|
| 43 30 006 | 3/1995 | (DE) . |
| 0 317 202 | 5/1989 | (EP) . |

* cited by examiner

*Primary Examiner*—Peter Vo
*Assistant Examiner*—Hermant M. Desai
(74) *Attorney, Agent, or Firm*—Pillsbury Winthrop LLP

(57) ABSTRACT

A packet for long articles comprises a first inner wrap around a group of articles and a second outer wrap around the first wrap which, together with the inner frame, envisaged when the packet is of the rigid type with hinged lid, constitute specific packaging components of the packet. The packet is equipped with a length of magnetic strip for data storage which is applied directly to a specified part of at least one of the specific packaging components in a hidden position not visible from the outside of the packet. If the packet has a revenue stamp or an insert, constituting additional components, the length of magnetic strip may be applied to at least one of said additional components, again in a hidden position.

11 Claims, 3 Drawing Sheets

PACKET FOR LONG ARTICLES AND THE RELATED PACKAGING METHOD

BACKGROUND OF THE INVENTION

The present invention relates to a packet for long articles.

The invention relates in particular to a packet for products designed for smoking, such as cigarettes or cigars, to which the specification below refers but without thereby restricting the scope of the invention, and applies to both soft and rigid packets.

Normally, soft cigarette packets have a substantially parallelepipedal shape and consist of an inner wrap made of paper or foil, placed right around a group of cigarettes, and an outer wrap or label made from a length of wrapping material, usually paper, placed partly around the first wrap in such a way as to leave the top end of the latter free.

Similarly, rigid cigarette packets are also substantially parallelepipedal in shape and consist essentially of a box-like outer wrap made from a ready-weakened flat blank, usually paperboard, designed to contain an inner wrap, usually paper or foil, holding a group of cigarettes and identical to the inner wrap used for soft packets. The box-like outer wrap usually comprises a cup-shaped container, a lid, also cup-shaped, hinged to a rear edge of the container and an inner frame placed partly inside the container and attached to the front sidewall and to two lateral sidewalls of the container itself.

Normally, the outer wrap has a revenue stamp on it, which may be applied in many different ways according to diverse requirements, and in some cases, packets of the type described above include inserts such as cards, coupons, or similar items, bearing text, figures, or, more often, images which constitute messages of various kinds directed at consumers.

Both the inner wrap and the outer wrap, whether the latter is made from a length of wrapping material or from a ready-weakened flat blank, constitute specific packaging components of the respective type of packets, while the stamp and insert are additional components.

Cigarette packets of the type described above are also wrapped and sealed with a protective overwrap made from transparent plastic film, for example, polypropylene, equipped with a tear strip designed to enable the overwrap to be easily torn in order to gain access to the outer wrap to open the packet of cigarettes.

In the cigarette packaging industry, the outer wraps of the packets have messages or bar codes printed on the outside of them which can be read using optical scanners without opening the packets. These messages or bar codes provide information such as the type of product contained, the place of manufacture, the date of production, and other data which can be used by distributors to organize and manage their stocks.

Since these informative messages and codes are usually relatively large and, if printed directly on the outside of the packet, interfere with the trademarks appearing on the packet, it is now common practice, according to patent EP 317,202, to use in their place a magnetic strip as tear strip or sealing strip. The strip is of the same type as the tape used in the audio or video recording sector, and has data recorded on it using conventional magnetic recording technology in a form which can be read by magnetic reading equipment. Strips of this kind are applied in visible parts of cigarette packets or of finished products in general. In the case of cigarette packets in particular, the tear strip is applied directly to the polypropylene of the protective overwrap in a position that is clearly identifiable and visible from the outside.

In the tobacco industry, conventional non-magnetic tear strip is usually applied to the plastic overwrap by thermosealing. As is well-known, this has the disadvantage created by the high thermal inertia of the sealing devices, which must be heated to high operating temperatures in order to effect sealing correctly even at the high operating speeds of current packaging machinery which allow the tear strip and wrapping material to remain in contact with the sealing devices for a very short time.

The heat regulation system must therefore be extremely sophisticated and precise in order to prevent critical temperatures from being reached, as such temperatures cause the tear strip and wrapping material to melt if the tear strip and wrapping material are not fed at the optimum rate and thus remain in contact with the sealers for longer lengths of time.

This constitutes an even greater problem if the tear strip is made of magnetic material. Thus, even if the temperature of the sealers can be regulated accurately enough to correctly thermoseal a conventional tear strip to the overwrap without reaching critical temperatures, in the case of a tear strip with magnetic properties, the sealing temperature, even if perfectly regulated, may cause weak thermal stresses that destroy the magnetizing properties of the tear strip itself or, in the case of information recorded on the tear strip before it is thermosealed, may corrupt the information, thus making it illegible.

SUMMARY OF THE INVENTION

The aim of the present invention is to provide a packet for long articles, especially products designed for smoking, that overcomes the problems described above, that does not need to have messages or codes printed on its outer wrap and that is difficult to counterfeit by unauthorized tobacco companies.

Accordingly, the present invention provides a packet for long articles, with at least one first inner wrap around a group of said articles and a second outer wrap around the first, said first and second wraps constituting specific packaging components, the packet comprising at least one magnetic data storage medium applied directly to at least one specified part of at least one of the specific packaging components, of which there are at least two.

Another aim of the present invention is to provide a method of making packets for long articles, especially products designed for smoking, which makes it possible to avoid the complications described above and overcomes the disadvantages mentioned above with reference to the state of the art.

Accordingly, the present invention provides a method of making packets for long articles, designed for smoking, each packet having at least one first inner wrap around a group of said articles and a second outer wrap around the first, said first and second wraps constituting specific packaging components of the packet, the method comprising the following steps, for each packet to be made: feeding a first wrapping material, constituting a specific packaging component, along a first given path in a first given direction to an applicator unit; feeding a magnetic data storage medium along a second given path in a second given direction to said applicator unit; applying said magnetic data storage medium to at least one specified part of the first wrapping material at said applicator unit; feeding said first wrapping material with the magnetic data storage medium attached to it along a third given path in a third given direction, to a packaging station where each packet is made.

BRIEF DESCRIPTION OF THE DRAWINGS

The invention will now be described with reference to the accompanying drawings which illustrate preferred embodiments of it and in which.

DESCRIPTION OF THE PREFERRED EMBODIMENTS

Figure 1:
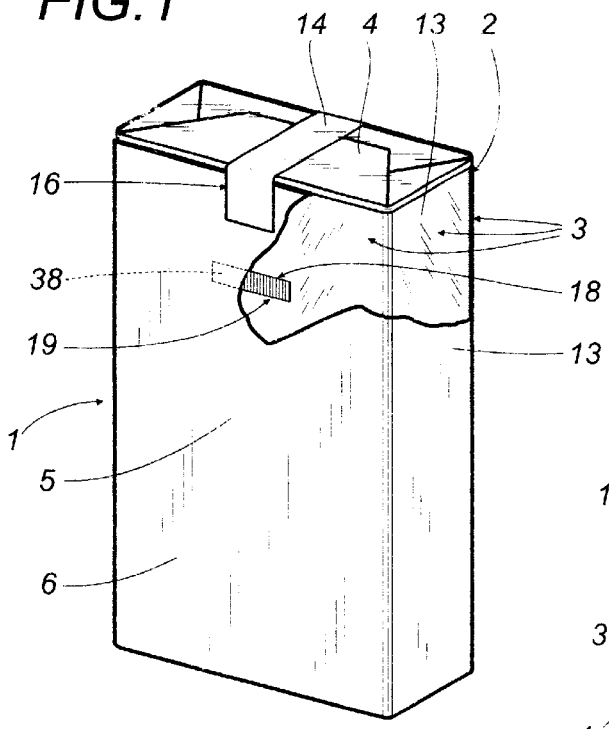
FIG. 1 is a perspective view of an embodiment of a soft packet for products designed for smoking, with part of the outer wrap cut away in order to better illustrate another part made in accordance with the present invention.

With reference to FIGS. 1 through 8, the numeral 1 indicates as a whole a packet designed to contain a group of cigarettes (not illustrated), wrapped completely in a conventional inner wrap 2 made of foil and having a substantially parallelepipedal shape defined by four sidewalls 3, a bottom end (not illustrated) and a top end 4.

Figure 2:
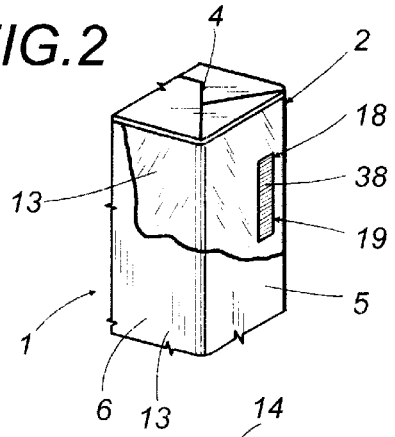
FIGS. 2 and 3 are two different perspective views of portions of the packet shown in FIG. 1, illustrating two different embodiments of the packet.
Figure 3:
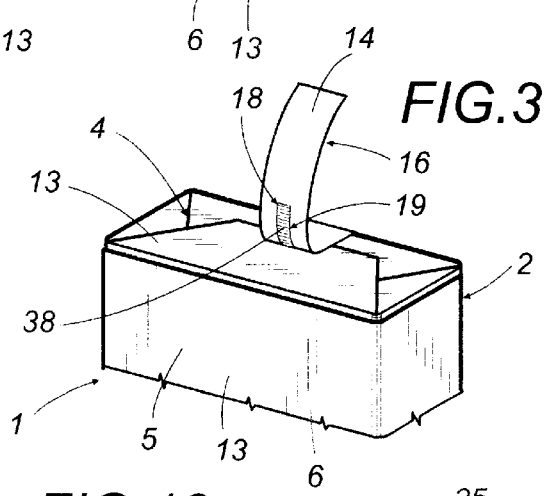
Figure 11:
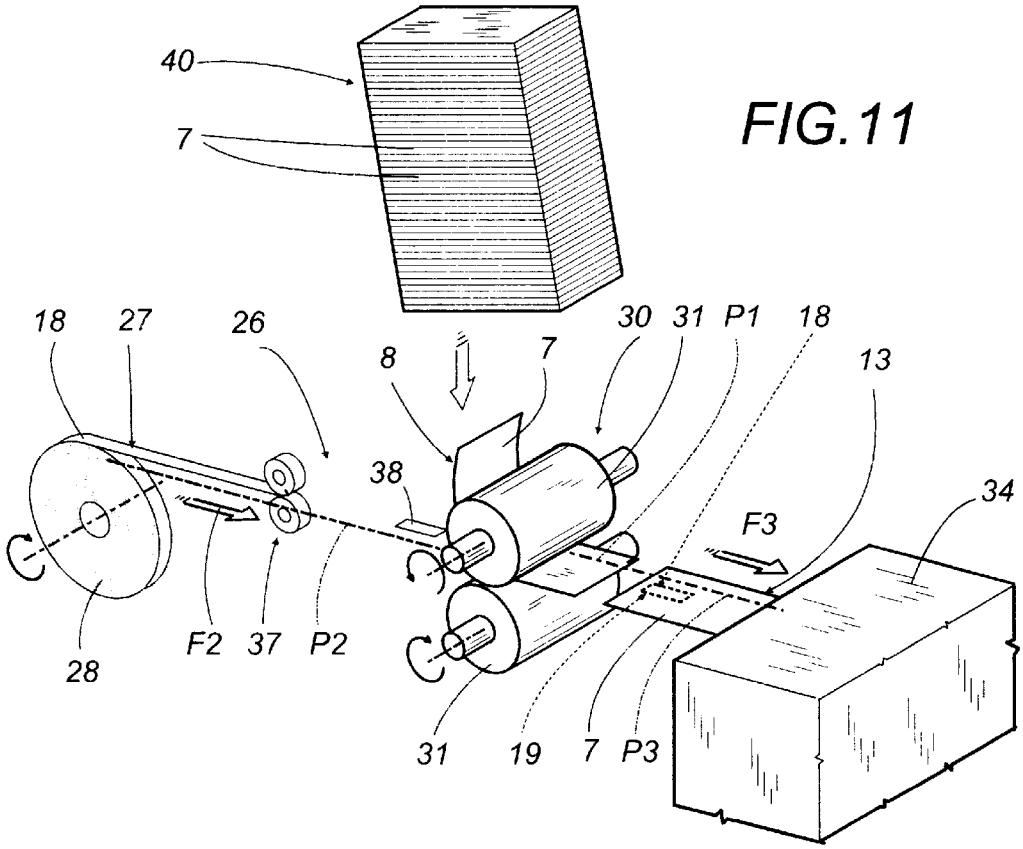
FIG. 11 is a schematic perspective view of a portion of the production line of a packaging machine designed to make the packet illustrated in FIG. 1.

In each packet 1, the inner wrap 2 is placed inside an outer wrap 5 which, in the embodiments of a soft packet 1 illustrated in FIGS. 1 through 3, is defined by a label 6 placed partly round all except the top end 4 of the inner wrap 2 and is made from a length 7, illustrated in FIG. 11, of a first soft wrapping material 8.

In the embodiments of a rigid packet 1 illustrated in FIGS. 4 through 8, the outer wrap 5 comprises a cup-shaped container 9 at the bottom and a lid 10 at the top, also cup-shaped and hinged to the container 9 so that it can rotate from a closed position (FIG. 4) to an open position (not illustrated). The rigid packet 1 also comprises an inner frame 11 placed partly inside the container 9 and attached to the front wall 3 and to two lateral sidewalls 3 of the container 9. The container 9 and the lid 10 are made (in a known manner, not illustrated) from a ready-weakened flat blank 12, illustrated in FIG. 10, which is in turn made of a first wrapping material 8, which the inner frame 11 is also made of.

Both the inner wrap 2 and the outer wrap 5, whether the latter is made from a length 7 of a first wrapping material 8 or from a ready-weakened flat blank 12, constitute, together with the inner frame 11, specific packaging components of the soft or rigid types of packets, these specific packaging components being hereinafter labeled 13 as a whole.

Figure 7:
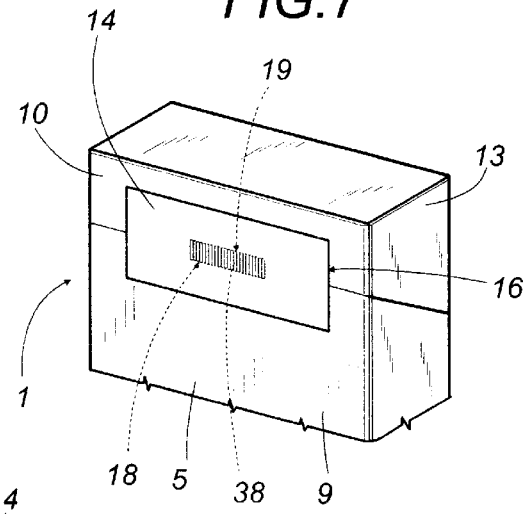

Usually, both the soft packet 1 and the rigid packet 1 have a revenue stamp 14, which in the case of the soft packet 1, illustrated in FIGS. 1 and 3, is applied over the top end 4 of the inner wrap 2, the two ends of the stamp reaching the top edge of the corresponding label 6, while, in the case of the rigid packet 1, illustrated in FIG. 7, it is applied to the rear sidewall 3 of the corresponding outer wrap 5.

Figure 8:
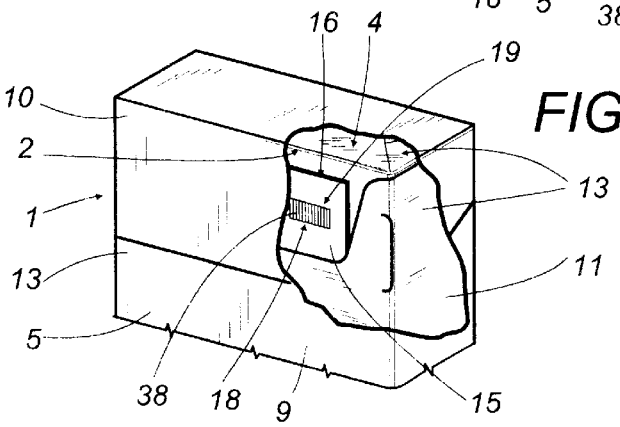

As shown in FIG. 8, the rigid packet 1 may have an insert 15 such as a card, coupon or similar items bearing text, figures, or, more often, images which constitute messages of various kinds directed at consumers.

The revenue stamp 14 and insert 15 constitute additional packaging components, hereinafter labeled 16 and made of a second wrapping material 17.

As illustrated in FIGS. 1, 2, 4, 5 and 6, each packet 1 comprises a magnetic data storage medium 18 applied to a specified area 19 of at least one of the specific packaging components 13 of the packet 1, that is to say, the magnetic data storage medium 18 is applied to the corresponding area 19 in a hidden position not visible from the outside of the packet 1.

Figure 5:
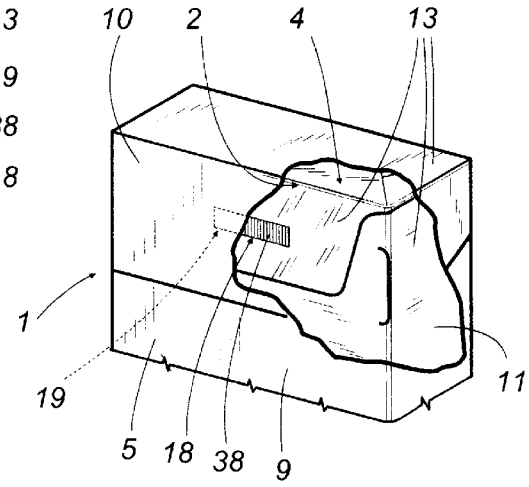
FIGS. 5, 6, 7 and 8 are four different perspective views of portions of the packet shown in FIG. 4, illustrating four different embodiments of the packet.

In particular, in FIGS. 2 and 5, the magnetic storage medium 18 is applied directly to a well-defined area 19 of the foil forming the inner wrap 2 and is therefore covered by the label 6 in the case of a soft packet 1, illustrated in FIG. 1, and by the lid 10 in the case of a rigid packet 1, illustrated in FIG. 5.

Figure 4:
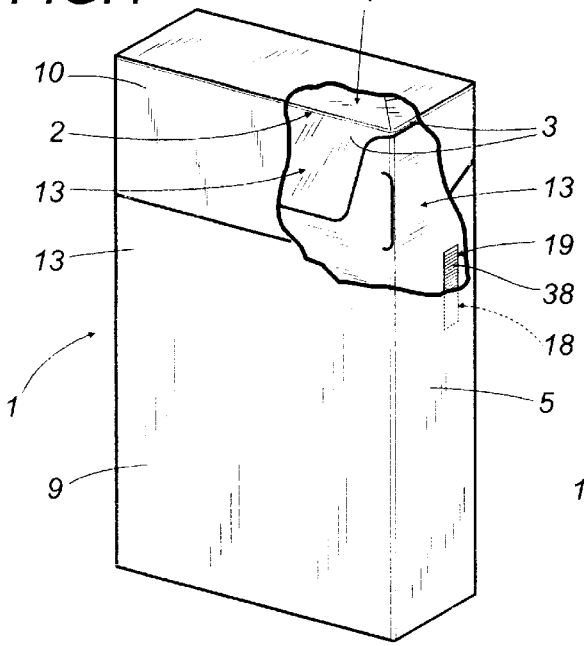
FIG. 4 is a perspective view of an embodiment of a rigid, hinged-lid packet for products designed for smoking, with part of the outer wrap cut away in order to better illustrate another part made in accordance with the present invention.

In FIGS. 1 and 4, the magnetic storage medium 18 is applied directly to a well-defined area 19 of the inside surface of the outer wrap 5, that is to say, in FIG. 1, it is applied directly to an area 19 of the inside surface of the label 6, whilst in FIG. 4, it is applied directly to an area 19 of the inside surface of the lid 10 or of the container 9.

Figure 6:
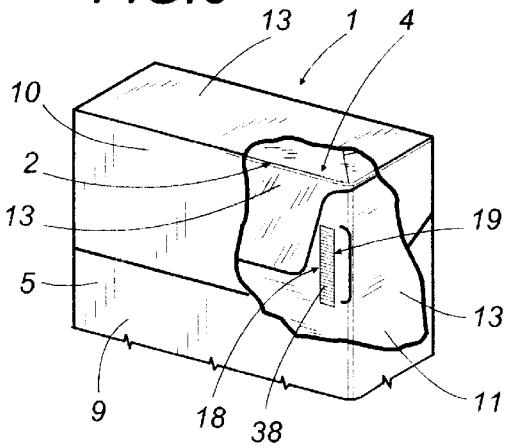

FIG. 6 on the other hand, shows the magnetic storage medium 18 applied directly to a well-defined area 19 of the outside or inside surface of the inner frame 11.

The area 19 where the magnetic storage medium 18 is applied may be located anywhere on the inner wrap 2, on the outer wrap 5 and on the inner frame 11 and the position may vary with each different batch of packets 1 to be made. What is important is that the medium 18 is not visible from the outside of the packet 1.

As shown in FIGS. 3 and 7, the magnetic storage medium 18 can be applied directly to the inside surface of the stamp 14 which comes into contact with the top end 4 of the inner wrap 2 or of the label 6, in the case of the soft packet 1 illustrated in FIG. 3 or with the outer wrap 5 in the case of the rigid packet 1 illustrated in FIG. 7.

Finally, as shown in FIG. 8, the magnetic storage medium may be applied directly to a well-defined area 19 of the outside or inside surface of the insert 15.

Figure 12:
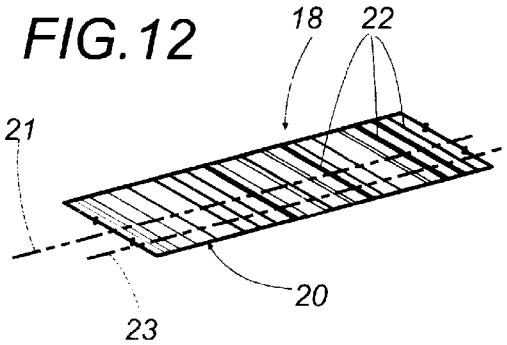
FIG. 12 is a schematic perspective view of an embodiment of a magnetic data storage medium.

According to a preferred embodiment illustrated in FIG. 12, the magnetic data storage medium 18 consists of a layer 20 of plastic, resistant to relatively high temperatures, extending mainly along an axis 21 and having a set of separate magnetic elements 22 applied to it, these being distributed in such a way that, once they are magnetized, they form a preset code which provides a given piece of information.

In this embodiment, the medium 18 is usually pre-recorded and the preset code is obtained by distributing the separate magnetic elements 22 along a given distribution line 23 which is substantially parallel to, or coincident with, the axis 21 and by varying the spacing and/or size of the magnetic elements 22.

Figure 13:
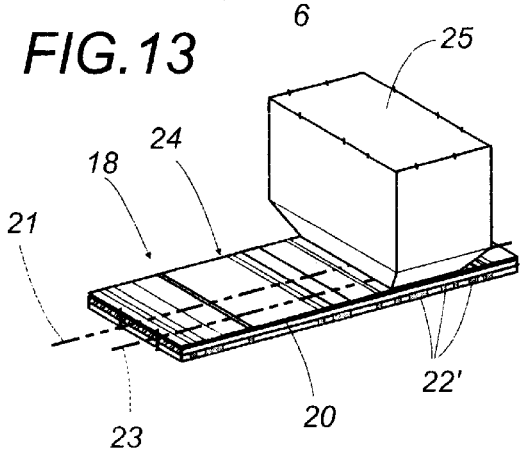
FIG. 13 is a schematic perspective view of another embodiment of a magnetic data storage medium.

In FIG. 13, the magnetic data storage medium 18 consists of a layer 20 of plastic, resistant to relatively high temperatures, and also extending mainly along an axis 21. A first face-of the layer 20 has a continuous, uniform layer 24 of magnetic material with a high magnetic coercive force. On the face of the plastic layer 20 opposite the face with the continuous, uniform layer of magnetic material 24, there is a continuous, uniform layer of magnetizable material. In this particular embodiment, the continuous magnetizable layer is designed to be magnetized at certain positions in such a way as to form magnetized elements, labeled 22', distributed along a line 23 that is substantially parallel to, or coincident with, the axis 21 of the plastic layer 20.

This is achieved by the effect of the mutual magnetic induction generated by the magnetic layer 24 with high coercive force each time the latter is subjected to a pulse of a magnetic field generated by magnetic writing means, consisting of a magnetic write head 25 which acts directly on the magnetic layer 24 with high coercive force. In this way, the head 25, controlled by a conventional control circuit (not illustrated), magnetizes the continuous layer so as to define a preset succession of the elements 22' to form a code that provides a given piece of information.

Figure 9:
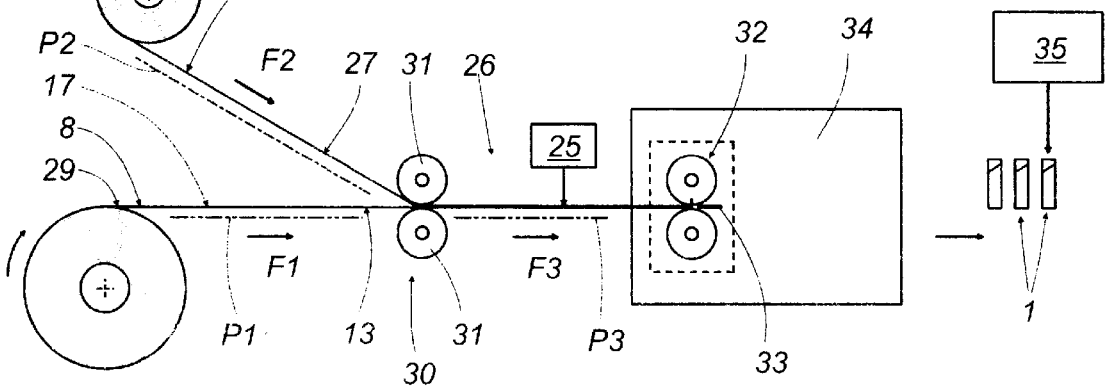
FIG. 9 is schematic, generic side view of a portion of the production line of a packaging machine designed to make the packets illustrated in FIGS. 1 to 8, whether of the soft or rigid type.

As shown in FIG. 9, which generically represents a part of a packaging machine labeled 26 as a whole, the magnetic medium 18 is made in the form of a continuous strip 27 wound on a corresponding bobbin 28. In this generic embodiment of the part of packaging machine 26, each specific packaging component 13 of the packets 1 may be obtained from a continuous tape 29 of a first wrapping material 8, which, during use, is fed along a first given path P1 in a first given direction F1 to an applicator unit 30 of known type, consisting, for example, of a pair of counter-rotating rollers 31, to which the magnetic strip 27 is fed at the same time and in synchrony along a second given feed path P2 in a second given direction F2. At said unit 30, of known type, consisting, for example, of a pair of counter-rotating rollers 31 located on opposite sides of said first and second feed paths P1 and P2, the strip 27 is applied to at least one specified area of the first wrapping material 8.

Thereafter, the wrapping material 8, with the strip 27 attached to it, is fed along a third given path P3 in a third given direction F3 to a station 32 where the wrapping material is cut into lengths 33, each with a piece of strip 27 attached to it, the lengths being then fed to a packaging station 34 where the packets 1 are made.

In the embodiment illustrated in FIG. 9, a magnetic strip 27 of the type illustrated in FIG. 13 is usually used and, downstream of the applicator unit 30, there is a magnetic write head 25 designed to record a code on the magnetic strip 27 in the manner described above. Downstream of the packaging station 34, another magnetic head may be envisaged, this one being a read head designed to check that the code has been recorded correctly.

It should be noticed that, in the embodiment illustrated in FIG. 9, the first wrapping material 8, may consist of foil used to make the inner wrap 2, or wrapping material forming the label 6 in the case of soft packets 1, or a wrapping material used to make the inner frames 11 or the inserts 15 in the case of rigid packets 1. In the case of the inserts 15, the continuous tape 29 will consist of a tape of a second wrapping material 17 used to make said additional components 16. This is true even in the case where the strip 27 is applied to the stamp 14.

Figure 10:
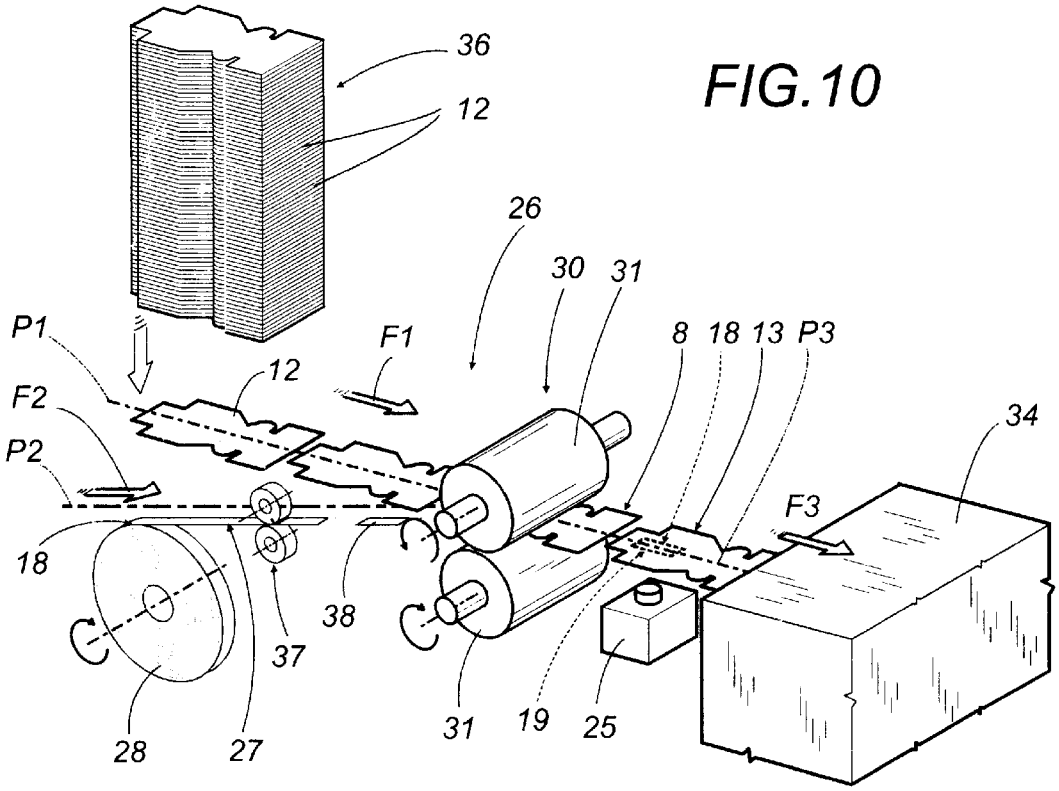
FIG. 10 is a schematic perspective view of a portion of the production line of a packaging machine designed to make the packet illustrated in FIG. 4.

In FIG. 10, the part of packaging machine 26 is used to make rigid packets 1. In this case, during use, a plurality of ready-weakened flat blanks 12, fed out of a magazine 36, are moved in succession along the first feed path P1 and in the first direction F1 to said applicator unit 30. At the same time and in synchrony with this, the magnetic strip 27 is fed along the second path P2 in the second direction F2 to said applicator unit 30, through a cutting station 37 which cuts the strip 27 into lengths 38 which are then fed to said unit 30 where they are applied to a specified area 19 of each blank 12 at a position where it will not be visible from the outside when the blank 12 is folded around the corresponding wrap 2 placed around a group of cigarettes.

Each blank 12 with the length 33 of magnetic strip 27 applied to it is then fed along the third path P3 in the third direction F3 to a packaging station 34.

In the embodiment illustrated in FIG. 10, the strip 27 may be used in the form illustrated in FIG. 13 and may therefore be magnetically recorded by the write head 25 downstream of the unit 30 or it may be used in the form illustrated in FIG. 12, that is to say, it is a pre-recorded strip 27.

The pre-recorded strip 27 can also be used in the embodiment illustrated in FIG. 9. In this case, a number or piece of information might be associated with a given combination of magnetic elements 22 with a specified spacing between them so that each packet 1 has on it, in a specified hidden position 19, a length 33 of magnetic strip having a specified code recorded on it.

Finally, in the embodiment illustrated in FIG. 11, where the portion of packaging machine 26 is used to make soft packets 1, a series of lengths 7 of first, soft wrapping material 8, consisting for example of a label 6, fed out from a magazine 40, are fed along the first path P1 in the direction F1 to the applicator unit 30, in exactly the same way as described for the embodiment illustrated in FIG. 10. At the same time and in synchrony with this, the magnetic strip 27 is fed along the second path P2 in the second direction F2 towards the unit 30 through a cutting station 37 which cuts the strip 27 into lengths 38 which are then fed to said unit 30 where they are applied to a specified area 19 of each length 7 at a position that will not be visible from the outside when the label 6 is folded around the corresponding wrap 2 placed around a group of cigarettes.

The advantages of this type of packet 1 are due to the fact that the length 38 of strip 27 of magnetic material is not visible from the outside and provides an effective means of preventing the packets from being counterfeited. Moreover, the use of a magnetic medium 18 of the type described above and illustrated in FIGS. 12 and 13, applied directly to the first wrapping material 8 or second wrapping material 17 eliminates the problem connected with the relatively high thermosealing temperatures reached by the wrapping machines used to overwrap the packets with a film of thermosealable plastic.

What is claimed is:

1. A method of making at least one packet for holding a group of elongated articles, wherein each packet having at least one first inner wrap surrounding the group of articles and a second outer wrap surrounding the first inner wrap, the first inner wrap and the second outer wrap constituting specific packaging components of the packet, wherein the method comprises:

feeding a wrapping material, along a first given path in a first given direction to an applicator unit;

feeding a magnetic data storage medium along a second given path in a second given direction to the applicator unit;

applying the magnetic data storage medium to at least one specified part of the wrapping material at the applicator unit;

feeding the wrapping material with the magnetic data storage medium attached thereto along a third given path in a third given direction to a packaging station;

supplying a first inner wrap material to the packaging station;

supplying a second outer wrap material to the packaging station;

assembling the first inner wrap material, the second outer wrap material and the wrapping material containing the magnetic data storage medium such that the magnetic data storage medium is disposed between the first inner wrap material and the second outer wrap material and is not visible when the first inner wrap material and the second outer wrap material are in an assembled configuration.

2. The method according to claim 1, further comprising:

feeding a continuous tape of said wrapping material along the first path in the first direction to the applicator unit;

feeding the magnetic data storage medium from a continuous strip unwound from a bobbin, along the second path in the second direction to the applicator unit;

cutting said tape of wrapping material, with the magnetic data storage strip attached to it, into specified lengths; and feeding each length of wrapping material, with the magnetic data storage strip attached to it, to a packaging station.

3. The method according to claim 1, wherein the feeding the magnetic data storage medium comprises:

feeding a continuous magnetic data storage strip along the second path in the second direction;

cutting the magnetic data storage strip into lengths, then feeding each single length of strip to the applicator unit; and applying each length of magnetic data storage strip to the wrapping material.

4. The method according to claim 1, wherein the magnetic data storage medium consists of a layer of plastic having a series of separate magnetic elements secured thereto to form a preset code designed to provide a given piece of information.

5. The method according to claim 4, wherein the magnetic data storage medium is fed to the applicator unit with a pre-recorded code on it.

6. The method according to claim 4, further comprising, magnetically recording a preset code on the magnetic storage medium after attaching the magnetic data storage medium to the wrapping material.

7. The method according to claim 1, wherein the wrapping material containing the magnetic data storage strip is positioned between the first inner wrap material and the second outer wrap material when in an assembled configuration.

8. The method according to claim 7, wherein the wrapping material containing the magnetic data storage strip is secured to the first inner wrap material.

9. The method according to claim 7, wherein the wrapping material containing the magnetic data storage strip is secured to the second outer wrap material.

10. The method according to claim 1, wherein the wrapping material is the first inner wrap material.

11. The method according to claim 1, wherein the wrapping material is the second outer wrap material.

* * * * *